US008186091B2

(12) United States Patent
Mardaga et al.

(10) Patent No.: US 8,186,091 B2
(45) Date of Patent: May 29, 2012

(54) EXCHANGEABLE CHOKE FOR A FIRE ARM WITH A SMOOTH GUN BARREL

(75) Inventors: Joseph Mardaga, Wandre (BE); Thierry Dumortier, Oupeye (BE)

(73) Assignee: Browning International, Societe Anonyme, Herstal (BE)

( * ) Notice: Subject to any disclaimer, the term of this patent is extended or adjusted under 35 U.S.C. 154(b) by 0 days.

(21) Appl. No.: 12/548,646

(22) Filed: Aug. 27, 2009

(65) Prior Publication Data

US 2010/0050493 A1 Mar. 4, 2010

(30) Foreign Application Priority Data

Aug. 28, 2008 (BE) ..... 2008/0476

(51) Int. Cl.
*F41A 21/40* (2006.01)

(52) U.S. Cl. ..... 42/79; 89/14.05

(58) Field of Classification Search ..... 42/79; 89/14.2, 89/14.3, 14.05
See application file for complete search history.

(56) References Cited

U.S. PATENT DOCUMENTS

| | | | | | |
|---|---|---|---|---|---|
| RE20,958 | E | * | 12/1938 | White | 42/79 |
| 2,932,915 | A | * | 4/1960 | Wilson | 42/79 |
| 2,968,111 | A | * | 1/1961 | Steane | 42/79 |
| 2,977,702 | A | * | 4/1961 | Schacht | 42/79 |
| 3,166,865 | A | * | 1/1965 | Grahn | 42/79 |
| 4,386,477 | A | * | 6/1983 | Briley | 42/79 |
| 4,447,975 | A | | 5/1984 | Ljutic | |
| 4,467,546 | A | * | 8/1984 | Beretta | 42/79 |
| 5,157,211 | A | * | 10/1992 | Mossberg | 42/79 |
| D343,222 | S | * | 1/1994 | Morales | D22/108 |
| 5,315,912 | A | * | 5/1994 | Huber et al. | 89/1.816 |
| 5,317,825 | A | * | 6/1994 | Vatterott et al. | 42/79 |
| 5,698,810 | A | * | 12/1997 | Rose | 89/14.3 |
| 6,026,728 | A | * | 2/2000 | Guhring et al. | 89/14.5 |
| 6,052,935 | A | * | 4/2000 | Howard | 42/79 |
| 6,135,216 | A | * | 10/2000 | Lyon et al. | 175/296 |
| 6,782,651 | B1 | * | 8/2004 | Walker et al. | 42/79 |
| 6,990,764 | B2 | * | 1/2006 | Walker | 42/79 |
| 7,523,581 | B1 | * | 4/2009 | Leutenegger et al. | 42/79 |
| 2004/0154209 | A1 | * | 8/2004 | Walker | 42/79 |

FOREIGN PATENT DOCUMENTS

| | | | |
|---|---|---|---|
| EP | 0218297 | A1 | 4/1987 |
| FR | 2511492 | | 2/1983 |
| FR | 2794522 | A1 * | 12/2000 |

OTHER PUBLICATIONS

Search Report of European Patent Office regarding Belgium Patent Application 2008/0476, May 27, 2009.

* cited by examiner

*Primary Examiner* — Benjamin P Lee
(74) *Attorney, Agent, or Firm* — Bacon & Thomas, PLLC

(57) ABSTRACT

Exchangeable choke for a fire arm with a smooth gun barrel, whereby said choke is provided with mechanical coupling means to mount and dismount the choke, characterized in that the choke is equipped with additional sealing means so as to seal the choke, at least in one place, in relation to the gun barrel, as well as to prevent the choke from being unscrewed during the shooting.

18 Claims, 2 Drawing Sheets

EXCHANGEABLE CHOKE FOR A FIRE ARM WITH A SMOOTH GUN BARREL

BACKGROUND OF THE INVENTION

A. Field

The present invention concerns an exchangeable choke for a fire arm with a smooth gun barrel.

B. Related Art

In particular, the invention concerns fire arms designed for shotgun cartridges whose charge, as is well known, consists of a certain quantity of small bullets or small balls of lead or another material.

It is known that when firing a cartridge, the impact of the lead shot has a certain dispersion which increases in proportion to the distance at which the impact takes place.

Said dispersion may be influenced by the use of what is called a choke.

The aim of this type of choke is to obtain a greater or lesser dispersion of the lead shot, whereby the choke forms a passage for the lead shot which extends in the continuation of the gun barrel and whose inner diameter is reduced in the direction of the muzzle of the gun barrel.

The course of the narrowing passage determines the degree of concentration of the impact of the lead shot.

The narrower the passage becomes, the higher the concentration of the impact.

The difference between the inner diameter of the gun barrel and the inner diameter at the muzzle is indicated by the term 'chokage'.

Depending on the type of target and the distance up to the target, a larger or smaller chokage will be indicated or desirable.

Traditionally, the chokes for fire arms are divided in two categories, i.e. what are called 'fixed chokes' and 'exchangeable chokes'.

In the case of fixed chokes, the chokage is realized in the mass of the gun barrel; to that end, the diameter of the gun barrel at the muzzle is varied as a function of the desired chokage.

Said fixed chokes are advantageous in that they do not require any additional maintenance.

They are disadvantageous, however, in that the chokage cannot be changed in a reversible manner depending on the shooter's needs.

Further, we know the category of exchangeable chokes.

An exchangeable choke comprises a bushing made of heat treated steel fixed to the inside of the muzzle of the gun barrel.

Here as well, the principle of the chokage is based on a reduction of the inner diameter in the direction of the muzzle of the gun barrel.

The advantage related to this category resides in that the chokage can be easily adapted to the needs of the shooter by mounting a choke having another configuration for the outlet diameter or by using a choke with variable chokage.

One of the inconveniences of these exchangeable chokes is that they tend to unscrew while shooting.

Another disadvantage of these exchangeable chokes is that they may get locked in the gun barrel.

Indeed, between the outer diameter of the choke and its seating or housing in the gun barrel, a functional clearance is indispensable.

Nevertheless, as a result, residues of powder, wad, lead shot, etc. may penetrate in the space between the choke and the gun barrel, such that, after a while, the piled dirt may cause the choke to get locked in the gun barrel of the fire arm. In that case, one may have to call a gunsmith to disassemble the parts or it may become entirely impossible to separate the latter without damaging them.

The problem is felt particularly in embodiments of chokes having an external screw thread by means of which the choke can be screwed in the housing of the gun barrel, whereby this housing is provided with a corresponding screw thread to that end. As fine screw threads are usually preferred, this mechanism is a delicate point of the screwed choke.

The present invention aims to provide a solution to one or several of the above-mentioned and other disadvantages.

SUMMARY OF THE INVENTION

To this end, the invention concerns an exchangeable choke for a fire arm with a smooth gun barrel, whereby said choke is provided with mechanical coupling means for mounting and dismounting the choke, characterized in that the choke is provided with additional sealing means to seal the choke, at least at one point, in relation to the gun barrel.

An advantage linked to the use of the sealing means is that it is practically impossible for the choke to become locked in its mounting position since these means prevent any dirt, i.e. mainly powder residues, wad or lead shot, to settle between the choke and the housing of the choke in the gun barrel, such that the choke, even after long shooting sessions, can be easily dismounted.

An additional advantage which also prevents dirt from settling is that the maintenance of the choke and the gun barrel is made easier, such that the help of an arms specialist is no longer required.

Traditionally, the above-mentioned mechanical coupling means are made in the form of a threaded connection.

Although other embodiments of the invention are not excluded, the present embodiment is taken as a basis for the following description.

The above-mentioned advantages also apply to the present embodiment. More specifically, the invention offers an effective protection against any locking of the choke in case of a screwed choke comprising a fine screw thread.

In a preferred embodiment, the sealing is guaranteed by means of a sealing ring made of elastomer or another flexible or thermoretractable material which is put in a contraction or recess provided in the external surface of the choke.

An advantage linked to this embodiment is that it is practically impossible for the choke to unscrew while shooting. The frictional forces resulting from the contact with the compressed sealing ring in the end generate a force couple which opposes the force couple required to dismount the choke.

Thanks to the application of the sealing ring in a contraction of the external surface, the sealing ring is prevented from being moved while the choke is being introduced in the gun barrel, According to a variant, the sealing means can be permanently fixed to the choke, for example by moulding the sealing means on the choke or by means of special glues.

Instead of realizing the sealings out of flexible materials, one can also use rigid materials such as metals or hard plastics.

When this type of material is used, one can realize sealings for example in the shape of a piston segment in conformity with the principle that is followed for sealing cylinders in a combustion engine.

BRIEF DESCRIPTION OF THE DRAWINGS

In order to better explain the characteristics of the invention, the following preferred embodiment of an exchangeable choke according to the invention for a fire arm with a smooth gun barrel is described by way of example only without being limitative in any way, with reference to the accompanying drawings, in which.

The working of the device is very simple and as described below.

Figure 1:
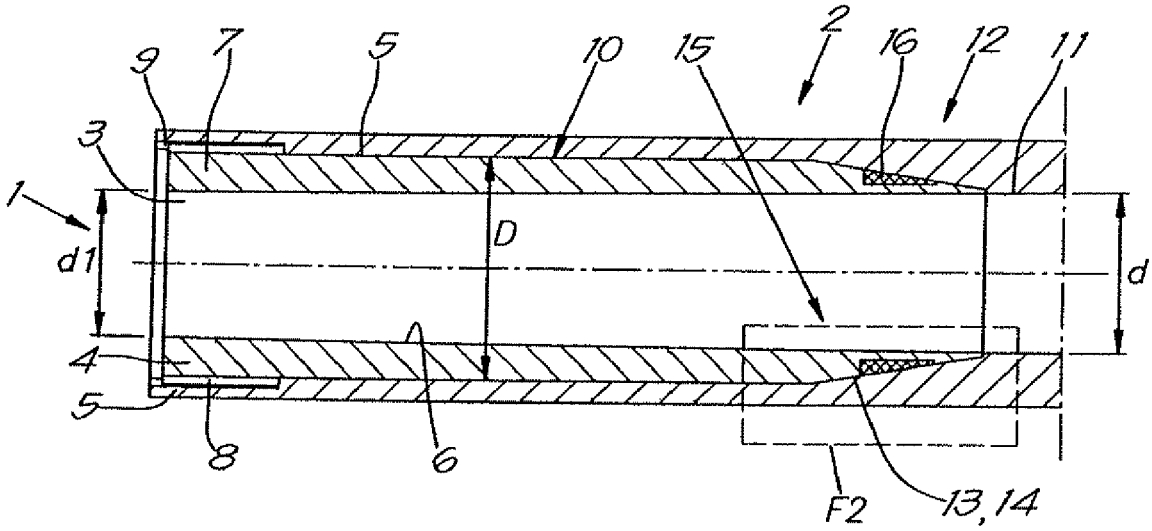
FIG. 1 shows a schematic section of an exchangeable choke according to the invention, mounted in the gun barrel of a fire arm with a smooth gun barrel.
Figure 2:
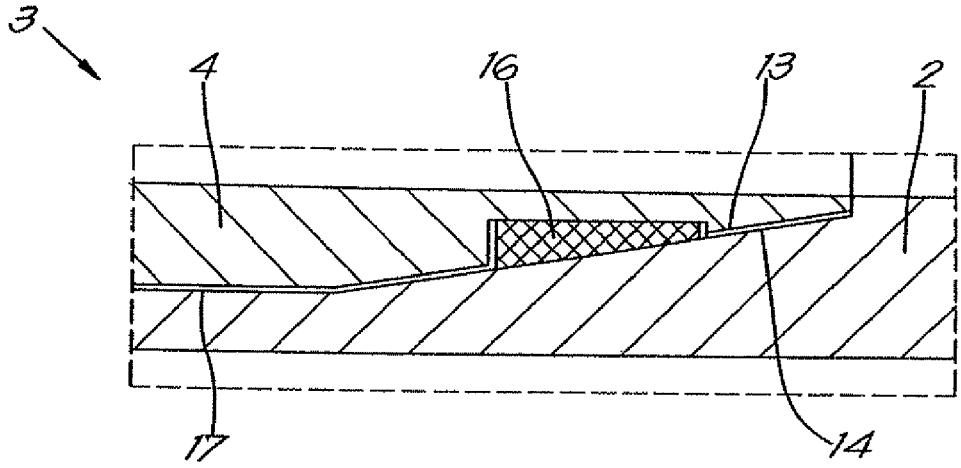
FIG. 2 shows the part represented by F2 in FIG. 1 to a larger scale.

FIG. 1 schematically represents the far end on the side of the muzzle 1 of a gun barrel 2 in which is mounted a choke 3.

DESCRIPTION OF PREFERRED EMBODIMENTS OF THE INVENTION

The choke 3 is mainly formed of a bushing 4 having an external surface 5 which is mainly cylindrical and an internal surface 6 forming a passage for the lead shot, which extends in a narrowing manner in the direction of one far end 7 of the bushing 4, namely the far end 7 directed towards the muzzle of the gun barrel 1.

Said far end 7 is provided with mechanical coupling means which in this case are made in the form of an external screw thread 8 over a certain length of the bushing 4 and which can work in conjunction with an internal screw thread 9 which is provided in the gun barrel 2, namely at the muzzle of the gun barrel 1, whereby the gun barrel is provided with a seating or housing 10 in the form of a part of the gun barrel 2 having an inner diameter D which is larger than the inner diameter of the bore 11 of the gun barrel 2.

At the other far end 12 of the choke 3, namely at the far end 12 which is directed towards the inside, a conically bevelled part 13 is provided which extends in a conically narrowing manner in the direction of the corresponding far end 12.

The housing 10 of the gun barrel 2 has a corresponding bevel 14 which extends in a narrowing manner in a direction which moves away from the muzzle of the gun barrel 1.

The bevelled part 13 of the choke 3 is provided with a contraction in which sealing means are provided made in the shape of a sealing ring 16 made of elastomer or a thermoretractable material.

The dimensions of the choke 3 and of the housing 10 of the gun barrel 2 are such that a functional clearance 17 is always obtained between them.

The diameters indicated in FIG. 1, i.e. d1 at the far end 7 of the choke 3 and d of the bore 11 respectively, determine the chokage of the choke 3.

The use of a choke 3 according to the invention is very simple and described hereafter.

Figure 3:
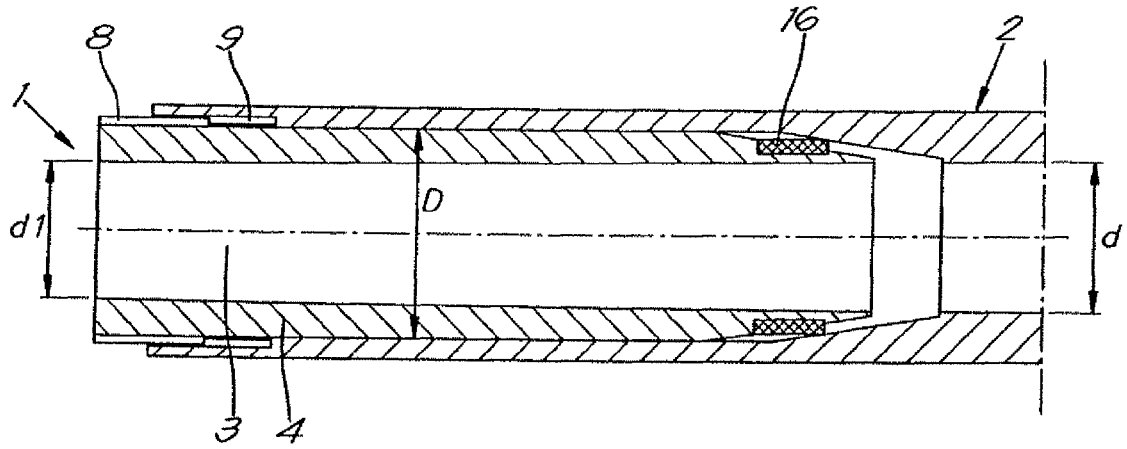
FIG. 3 is a view analogous to that in FIG. 1, but in which the choke is represented as partly dismounted.

The choke 3 takes place in the housing 10 of the gun barrel 2 with its conical far end 12 after which, as shown in FIG. 3, it is screwed down by means of the screw threads 8 and 9, such that the sealing ring 16 is compressed between the bevelled part 13 of the choke 3 and the bevelled part of the gun barrel 2 so as to obtain an effective sealing which prevents any powder residues to become incrusted while shooting a cartridge in the space created by the functional clearance 17 between the two loose parts.

Thanks to the corresponding bevelled parts 13 and 14, it becomes easier to centre the choke 3 while it is being mounted, and also the catch of the threaded connection 30 formed by the screw threads 8 and 9 is easier.

The length of the choke is preferably such that, as soon as the screw thread catches, the sealing ring 16 does not make contact with the gun barrel 2.

Consequently, in this catch phase, one does not have to deal with forces resulting from any contact between the sealing ring 16 and the gun barrel 2, such that the first part of the mounting is very simple.

In the second phase, after having sufficiently screwed the choke 3 and the gun barrel 2 into one another so as to obtain a good connection, the sealing ring 16 is put into contact with the gun barrel 2.

While the screwing continues, the sealing ring 16 is compressed in order to be able to fulfill its role as a sealing means.

During a shooting session, the thus obtained sealing will prevent any powder residues from penetrating through said sealing ring 16. Consequently, the sensitive threaded connection 8-9 and the space created for the functional clearance 17 will remain free from any dirt deposit.

As a result, the dismounting will not cause any problems and the necessary maintenance is restricted.

It is clear that the bevelled parts 13 and 14 are not strictly necessary according to the invention, and that for example a bushing 4 which has a cylindrical configuration over its entire length is also within the protected scope of the invention; in that case, a sealing may be provided in a contraction in the external cylindrical surface 5 or by making a recess in the surface at the far end of the bushing 4.

Although, in the given example, the bevelled part is situated at the far end 12 of the bushing 4, another place for said part is not excluded.

The position of the mechanical coupling means and of the sealing means can be modified in relation to the one that is used in the present example while still remaining within the scope of the invention.

Figure 4:
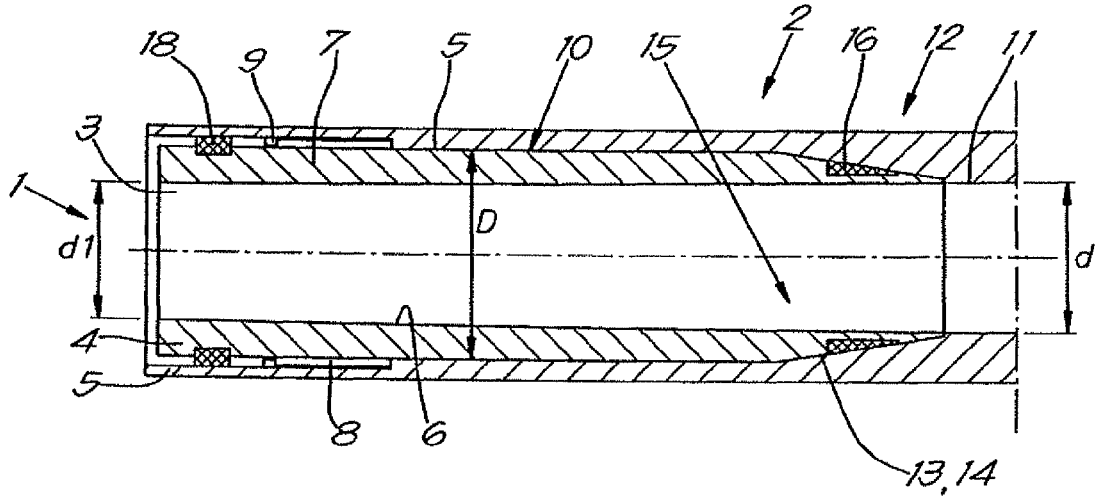
FIG. 4 is a view analogous to that in FIG. 1, but for a configuration comprising two sealing rings.

Another embodiment of the invention is shown in FIG. 4 and consists in providing the choke 3, apart from a first sealing ring 16 on the bore side, with a second sealing ring 18 on the muzzle side. Said sealing ring 18 can be formed with the same means as those that are used to form the first sealing ring 16.

This variant is advantageous in that, as soon as the choke 3 has been introduced completely, water can no longer penetrate between the outside of the choke 3 and its housing 10 in the gun barrel 2, nor will there be any contamination whatsoever by parasitical particles which could entail oxidation and adherence between the gun barrel 2 and the choke 3. Instead of the sealing ring 16, one may also use the earlier described variants while still remaining within the scope of the invention.

The present invention is by no means limited to the embodiment described above by way of example and represented in the accompanying drawings; on the contrary, an exchangeable choke 3 for a fire arm with a smooth gun barrel 2 according to the invention can be realized in all sorts of shapes and dimensions while still remaining within the scope of the invention.

The same applies to the housing 10 of the choke 3 in the gun barrel 2.

Also, the alternative which consists in fixing the sealing ring 16 in the housing 10 of the choke 3 situated in the gun barrel 2 falls within the scope of the invention.

The invention claimed is:

1. Exchangeable choke for a firearm with a smooth gun barrel, comprising a mechanical coupling arrangement enabling the choke to be mounted and dismounted on a smooth gun barrel, and a sealing arrangement configured so as to seal the choke at least at one place relative to a smooth gun barrel to prevent particles from entering into the mechanical coupling arrangement upon discharge, wherein the sealing arrangement comprises a sealing ring made of a flexible material and wherein the sealing arrangement is located in a contraction in the external surface of the choke, wherein the contraction is provided in a beveled part of the bushing.

2. Exchangeable choke according to claim 1, wherein the mechanical coupling arrangement comprises a screw thread.

3. Exchangeable choke according to claim 1, wherein the sealing arrangement is moulded on a bushing of the choke or secured to a bushing of the choke with glue.

4. Exchangeable choke according to claim 1, wherein the beveled part narrows conically.

5. Exchangeable choke according to claim 1, wherein the mechanical coupling arrangement is provided at one end of the bushing and the sealing arrangement is provided at an opposite end of the bushing.

6. Exchangeable choke according to claim 1, wherein the sealing arrangement is provided at the two ends of the bushing.

7. Exchangeable choke according to claim 1, wherein the mechanical coupling arrangement comprises a threaded connection, such that, upon the choke initially being threaded by engaging the cooperating threads in a gun barrel, the sealing arrangement is not in contact with the gun barrel.

8. Exchangeable choke claim 1, including a smooth gun barrel having a housing for the choke, and wherein the choke, on its external surface, and the housing for the choke in the gun barrel, have a cylindrical configuration over their entire length.

9. Firearm with a smooth gun barrel, including an exchangeable choke according to claim 1.

10. Exchangeable choke for a firearm with a smooth gun barrel, comprising a mechanical coupling arrangement enabling the choke to be mounted and dismounted on a smooth gun barrel, and a sealing arrangement configured so as to seal the choke at least at one place relative to a smooth gun barrel, wherein the sealing arrangement comprises a sealing ring made of a rigid material, the sealing arrangement is located between the choke and the barrel to create a seal between the choke and the barrel, and the sealing arrangement is located in a contraction in the external surface of the choke, wherein the contraction is provided in a beveled part of the bushing.

11. Exchangeable choke according to claim 10, wherein the mechanical coupling arrangement comprises a screw thread.

12. Exchangeable choke according to claim 10, wherein the sealing arrangement is moulded on a bushing of the choke or secured to a bushing of the choke with glue.

13. Exchangeable choke according to claim 10, wherein the beveled part narrows conically.

14. Exchangeable choke according to claim 10, wherein the mechanical coupling arrangement is provided at one end of the bushing and the sealing arrangement is provided at an opposite end of the bushing.

15. Exchangeable choke according to claim 10, wherein the sealing arrangement is provided at the two ends of the bushing.

16. Exchangeable choke according to claim 10, wherein the mechanical coupling arrangement comprises a threaded connection, such that, upon the choke initially being threaded by engaging the cooperating threads in a gun barrel, the sealing arrangement is not in contact with the gun barrel.

17. Exchangeable choke according to claim 10, including a smooth gun barrel having a housing for the choke, and wherein the choke, on its external surface, and the housing for the choke in the gun barrel, have a cylindrical configuration over their entire length.

18. Firearm with a smooth gun barrel, including an exchangeable choke according to claim 10.

* * * * *